US006831051B2

(12) United States Patent
Sommerville-Roberts et al.

(10) Patent No.: US 6,831,051 B2
(45) Date of Patent: Dec. 14, 2004

(54) POUCHED COMPOSITIONS

(75) Inventors: Nigel Patrick Sommerville-Roberts, Newcastle upon Tyne (GB); Andy Chi Chien Wong, Tyne & Wear (GB)

(73) Assignee: The Procter & Gamble Company, Cincinnati, OH (US)

( * ) Notice: Subject to any disclaimer, the term of this patent is extended or adjusted under 35 U.S.C. 154(b) by 49 days.

(21) Appl. No.: 10/278,655

(22) Filed: Oct. 23, 2002

(65) Prior Publication Data

US 2003/0114333 A1 Jun. 19, 2003

Related U.S. Application Data

(63) Continuation of application No. PCT/US01/07777, filed on Mar. 9, 2001.

(30) Foreign Application Priority Data

Apr. 28, 2000 (GB) ..... 0010234

(51) Int. Cl.[7] ..... C11D 17/04
(52) U.S. Cl. ..... 510/296; 510/439
(58) Field of Search ..... 510/296, 439, 510/297

(56) References Cited

U.S. PATENT DOCUMENTS

| | | | | | |
|---|---|---|---|---|---|
| 4,733,774 | A | * | 3/1988 | Ping et al. | 206/0.5 |
| 4,740,326 | A | * | 4/1988 | Hortel et al. | 510/295 |
| 4,745,021 | A | * | 5/1988 | Ping et al. | 428/195.1 |
| 5,520,838 | A | * | 5/1996 | Baeck et al. | 510/320 |
| 5,792,738 | A | * | 8/1998 | Baillely et al. | 510/375 |
| 6,576,604 | B1 | * | 6/2003 | Hoshino et al. | 510/438 |

FOREIGN PATENT DOCUMENTS

| | | |
|---|---|---|
| EP | 0 414 462 A2 | 2/1991 |
| EP | 0 593 952 A1 | 4/1994 |
| EP | 0 608 910 1 | 8/1994 |
| GB | 2000177 | 1/1979 |

* cited by examiner

*Primary Examiner*—Lorna M. Douyon
(74) *Attorney, Agent, or Firm*—Armina E. Matthews; Brahm J. Corstanje; Kim William Zerby

(57) ABSTRACT

The present invention relates to free-flowable compositions in a pouch which contain different free-flowable components fixed in different regions and to process for making these pouched compositions. The pouch and the compartment (s) thereof are preferably made from stretchable, elastic film which is water-soluble. The compositions are preferably cleaning compositions or fabric care compositions.

18 Claims, No Drawings

POUCHED COMPOSITIONS

CROSS REFERENCE TO RELATED APPLICATIONS

This is a continuation of International Application PCT/US01/07777 with an international filing date of Mar. 9, 2001, published in English under PCT Article 21(2) which claims benefit of Great Britain Application No. 0010234.3, filed Apr. 28, 2000.

TECHNICAL FIELD

The present invention relates to compositions in a pouch having a compartment containing different components fixed in different regions and process for making these pouched compositions.

BACKGROUND TO THE INVENTION

Cleaning compositions nowadays come in a number of product forms, such as granules, liquids and tablets, each form having its advantages and disadvantages.

Recently, tablets have gained renewed interest, mainly because they are easy to handle for the consumer and easy to dose ('unit dose') and they have as additional benefit that they allow incompatible ingredients to be incorporated separated from one another, for example in different layers. This can reduce the area of contact of these incompatible materials and thus reduce the occurrence of any reaction between such materials.

However, to make tablets storage stable and to prevent breakage of the tablets during handling, the ingredients need to be compressed together and generally binding agents are needed to ensure the tablets do not break. This can reduce their solubility and dispersibility, which is undesirable for the consumers and also from a performance point of view.

Thus, alternative ways or better ways are required for providing easy to handle, unit dose products whereby different ingredients can be present separate from one another in an easy way (for example to reduce intimate contact and improve stability of incompatible ingredients) which do not dust or break.

The inventors have now found an improved way for providing improved products addressing the above problems, namely by incorporating a product in a pouch in a specific way, such that the above requirements are fulfilled.

Pouches for detergents as such are known in the art to be useful to provide unit dose compositions and to separate ingredients from one another. For example, U.S. Pat. No. 5,224,601 describes a packages made with different compartments for different materials. However, this type of structure and also other pouches known in the art have their problems and often requires a complicated manufacturing route and a relatively large amount of sheet material.

The inventors have now found improved pouched particulate compositions which are such that intimate contact with different components thereof is reduced, without the need to compact them to the extent of tablets and without the need of difficult structures, such as multiple separate compartments, to separate different ingredients from one another. In the products of the invention, the different components of the compositions are namely packed tightly in different regions of one and the same compartment or pouch, such that they are substantially immobilised or fixed and thus remain like that during handling and storage. However, because the components are still in powder or granular form and are not stuck together as in tablets, the dissolution or dispersion of the composition comprising these components into water is very fast. Thus, improved storage stability of for example incompatible ingredients like enzymes and bleach is achieved, with a minimum of pouch material and with very good product delivery and performance.

Furthermore, improved processes are provided to form the pouched composition, such that the components in the regions stay fixed or immobilised.

SUMMARY OF THE INVENTION

The present invention provides a composition in a pouch, the composition comprising two or more particulate components and the pouch comprising one or more water-disintegrating, water-soluble or water-dispersable compartments, whereby at least two of the components are present in one and the same compartment and each form a fixed region in said compartment.

In particular, the composition in a pouch of the invention is obtainable by a process comprising the steps of:

a) obtaining a open pouch comprising an open compartment;

b) introducing one particulate component prior to at least one other particulate component in the open compartment and/or introducing one particulate component in a different part of the open component than at least one other particulate component; and c) subsequently closing the open compartment such that a pouch with a (water-soluble water or water-dispersible) compartment comprising fixed regions of said particulate components is obtained.

The components are so tightly packed that the regions are fixed, whilst the composition is still free-flowing (which can be noted when the pouch is removed). This provides the benefits as set out above.

Typically this can be done by overfilling the open compartment, using stretchable and preferably elastic material for the compartment, or using heat-shrinkable material for the compartment or filling and closing the open compartment under reduced pressure or even vacuum.

The composition in the pouch is preferably such that the bulk density of the composition after closing the compartment is 5% to 45% or even to 35%, preferably 5% to 30% or even 10% to 25% higher than the average of the bulk density of the components prior to introduction into the compartment.

Preferably, the pouch as a whole is water-soluble. Preferably the composition is a cleaning composition or fabric care composition or rinse additive composition.

The invention also provides processes for making the pouched compositions of the invention, for example by the process described above and preferred processes as claimed and described hereinafter. One preferred process is such that it results in a non-uniform thickness of the compartment material, which can provide very rapid release of product into water, or can help control the time of release of the different components to the wash water.

DETAILED DESCRIPTION OF THE INVENTION

Compositions and Components Thereof

The composition of the invention is present in a pouch and is herein also referred to as pouched composition. The composition comprises at least two different particulate components. Generally, the particulate component is a powder or granules, extrudate or flakes.

When used herein, 'different' component means that one component has at least one different chemical property, for example at least one different ingredient, than the other component or components, or one component has at least one different physical property than another component or component. Typically, one component comprises one or more oxidising ingredients and another component comprises one or more reducing ingredients or oxidisable ingredients. Examples are described herein after.

The particulate components are present in the compartment such that they form fixed or immobilized regions within this compartment.

The fixation of the regions limits the direct contact of the components of the composition with one another, preferably only to the area were the regions touch, without the need of separate compartment structures for the components.

Typically, regions are formed by introducing one particulate components into an open compartment prior to another particulate component, so that for example layers of components are obtained. Alternatively, or in addition, this can be formed by introducing one component in a different part of the open compartment.

Typically, the regions are fixed or immobilized by tightly packing the components together and ensuring that there is substantially no free head-space within the compartment which would allow the powders to move. Typically, the tight packing is such that the bulk density of the components after closing the compartment and thus the bulk density of the compositions in the pouch is from 5% to 45% preferably to 35%, preferably 5% or even 10% to 30% or even to 25% or it may be preferred that this is from 8% to 20% or even 15% higher than the average bulk density of the components prior to incorporation in the pouch.

The bulk density of a component prior to incorporation in the pouched composition can be determined by the Repour Cup method, as described in ISO 3424-1975-E. The average bulk density of the components prior to incorporation in the compartment is worked out by first measuring the bulk density of each component using ISO 3424. Then, a weighted average is calculated based on the weight percentage of the component in the final composition. For example, a pouch consist of one compartment with a composition consisting of two components A and B. Component A is present at 40% by weight of the final composition. Component B is present at 60% by weight of the final composition. Component A has a Repour Cup bulk density (as measured by ISO 3424) of 500 g/l. Component B has a bulk density of 800 g/l (as measured by ISO 3424). The average bulk density of the composition prior to being incorporated into the pouch is therefore $((500\times0.4)+(800\times0.6))=680$ g/l.

The average bulk density of the pouched composition, after closing of the compartment, can be determined by a method of volume displacement. A vessel with a wide neck and an off-take arm is filled with a solvent of known density, which must not affect the compartment material or pouch material, up to the level of the collecting arm. The pouched composition to be tested is accurately weighed and then immersed in the liquid, for example by using a piece of thin metal wire. The amount of liquid that is displaced by the pouched composition in the liquid leaves the vessel through the arm and is collected and carefully weighed. The volume of this displaced liquid is easily calculated from the weight and the known density of the liquid. The density and the volume replacement due to the pouch material (rather than the composition therein) can be measured or calculated. This is deducted from the volume replacement of the liquid as measured in the above test. The density of the composition can then be calculated. (Errors associated with the thin wire used to immerse the pouch are minor and are not taken into account.) Depending on the material of the pouch or compartment, a suitable liquid can be selected. For example, for water-soluble material such as PVA, preferred liquid is glycerol. This is because the pouches may contain microscopic pinholes in the film as a result of the stretching. Using a viscous solvent such as glycerol will minimize any errors due to liquid seeping into the pouch. Also useful are non-ionic surfactant such as Neodol 235.

The formation of fixed regions and the tight packing can be done by increasing the packing efficiency and reducing space between the particles of the components, for example by vibration of the components in the open compartment shape, allowing the components to settle for a period of time, modestly increasing pressure, for example by applying a pressure of up to 20 Mpa, preferably up to 10 Mpa or more preferably up to 5 Mpa or even up to 2 MPa, if any pressure is used, provided that the components and the composition remain free-flowing, The bulk density of the component can be achieved by a compaction step. Typically, the particulate component is first placed in the open compartment, and then a pressure is exerted on said component causing the bulk density of said component to increase from 5% to 50%, preferably from 10% or from 15% or from 20%, and preferably to 45%, or to 40%, or to 35%, or to 30% of the original bulk density of the component prior to the compaction step.

The pressure may be exerted in the form of a solid body, which is typically of a size and shape that is capable of fitting into the opening of the open compartment. The solid body is capable of applying pressure to said component. Preferably, the solid body applies a pressure of up to 20 Mpa, preferably up to 10 Mpa or more preferably up to 5 Mpa or even up to 2 MPa, to the particulate component.

To ensure tight packing of the components in the compartments, the particulate components are for example introduced in the open compartment (preferred processes herefor being described below) such that the open compartment is preferably almost completely filled, typically such that at least 95% of the volume of that open compartment shape, preferably at least 98% or even at least 100% of the open compartment shape is filled, prior to closing said open compartment shape, or it may even be preferred that the shape is overfilled with the components, i.e. that the volume of the components is more than 100% of the volume of the shape, preferably more than 105% or more preferably more than 110% or even more than 115%. Hereby, closing the open compartment which is filled for 95% by volume or more ensures that there is only very limited head-space in the compartment after closing and thus very limited movement of the components in that compartments, i.e. that the regions formed by the components are fixed.

The composition in the pouch herein can for example be obtained by a process involving a) obtaining an open pouch comprising an open compartment;

b) introducing one particulate component prior to at least one other particulate component in the open compartment and/or introducing one particulate component in a different part of the open component than at least one other particulate component; and c) subsequently closing the open compartment such that a pouch with a compartment comprising fixed regions of said particulate components is obtained.

In one preferred process, step c) of the process above may be performed under reduced pressure, lower than atmospheric pressure, preferably by applying a vacuum, so that after filling and closing under reduced pressure or vacuum, a tightly packed compartment is obtained.

The compartment is preferably formed from a stretchable material, preferably a film, preferably an elastic film, as described hereinafter. This is in particular useful if the open compartment is filled completely or even overfilled, and is closed by stretchable film, so that by stretching the part of the film used for closing the compartment and/ or by stretching the film of the open compartment, a tight packing and fixed regions are obtained. The use of an elastic material is then preferred, to ensure the tight packing remains over time.

Alternatively, the open compartment is rigid and in step b) the components are introduced in the open compartment such at least 100%, preferably at least 105% of the open compartment is occupied by the components, and the open compartment is then preferably closed with a stretchable material.

The formation of fixed regions and the tight packing may also be achieved by using for the compartment a shrinkable material, whereof the surface area is reduced during or subsequent to closing the open compartment by shrinking the material. A suitable material is for example heat-shrinkable material.

The formation of the open compartment or open shape can be done my any known method. Preferred open shapes are made by introducing the material to form the compartment on to a mold, then applying a vacuum to the mold, so that the material adopts the shape of the mold, also referred to as vacuum-forming. Another preferred method is thermoforming to get the material to adopt the shape of the mold.

The introduction of the components can be done by any method suitable for introducing free-flowing materials into molds.

Whilst the compartment comprises at least two particulate component, a liquid component may be added. It may be preferred to first introduce a first particulate component into the open compartment, then spraying on a small amount of liquid, typically 0.5–10% or even 1% to 5% by weight of the first component, preferably water and subsequently adding the second particulate component. Hereby, the regions can be even more fixed or immobilized.

The component comprises at least an amount of at least one particulate compound, but typically the component comprises at least two particulate compounds, preferably thoroughly mixed to form the component. Because the components in the compartment of the pouch are fixed in fixed regions, the interaction between the different components is reduced. This allows the incorporation in a composition of incompatible ingredients, by separating these per fixed region.

The composition herein can be any particulate composition, in particular any free-flowable granular or powder composition to be delivered to, and active in water.

Preferred compositions are beverages, edible compositions, pharmaceutical compositions, personal care compositions, cleaning compositions, fabric care or conditioning compositions; most preferably, the compositions herein are cleaning compositions or fabric care compositions, preferably hard surface cleaners, more preferably laundry or dish washing compositions, including detergents, pretreatment or soaking compositions or fabric conditioners, and other rinse additives.

When used in cleaning compositions the component can contain any active cleaning ingredients. In particular preferred are active ingredients such as surfactant, chelating agents, builders, enzymes, perfumes, bleaches, bleach activators, fabric softeners, fabric conditioners, antibacterial agents, effervescence sources, brighteners, photo-bleaches. Fabric care compositions preferably comprise at least one or more softening agents, such as quaternary ammonium compounds and/ or softening clays, and preferably additional agent such as anti-wrinkling aids, perfumes, chelants, fabric integrity polymers.

Generally, water is present at a level of 0% to 10%, more preferably from 0.2% to 5% or even 0.2% to 3% or even form 0.5% to 2% by weight of the compartment, preferably of the pouch.

Typically, the composition comprises such an amount of a cleaning composition, that one or a multitude of the pouched compositions is or are sufficient for one wash.

Although the nature of the pouched composition is such that it readily dissolves or disperses into the water, it may be preferred that disintegrating agents such as effervescence sources, water-swellable polymers or clays are present in the pouch or compartment material it self, and/ or in the composition therein; in particular effervescence sources based on an organic acid and a carbonate source are useful. Suitable acids include citric acid, malic acid, maleic acid, fumaric acid; suitable carbonate sources include sodium salts of carbonate, bicarbonate, percarbonate. Preferred levels for the disintegrating aids or effervescence sources or both are from 0.05% to 15% or even from 0.2% to 10% or even form 0.3 to 5% by weight pouched composition.

In particular, for cleaning compositions, it is beneficial that one component comprises at least one or more enzymes and another component comprises a peroxygen bleach such as a salt of percarbonate. The component containing the peroxygen bleach is then free of enzymes, whilst the component comprising the enzyme may comprise a bleach activator, but no peroxygen bleach.

It is also beneficial to include the bleaching agents, but in particular the peroxygen bleach in a different component than any hygroscopic materials or anhydrous or hydratable materials including overdried materials, such as aluminosilicates, anhydrous salts or acids.

When the pouched compositions is such that it has a visually distinguishable top and bottom side, and then, when the regions are in the form of layers, it can also be beneficial to include in the bottom layer non-gelling detergent ingredients, such as water-soluble salts and acids, including for example effervescing salts and acids such as carbonate salts and organic carboxylic acids such as citric acid, and in a higher or top layer potential gelling ingredients such as anionic and nonionic surfactants. Then, it is beneficial to include any peroxygen bleach in the bottom layer and any enzymes in the top layer, if required. It has been found that when such a pouched composition is introduced into the wash via a dispensing device, in particular a dispensing drawer, faster and more complete delivery to the wash is achieved.

It can be beneficial to include any surfactant and bleach into the compartment such that it is delivered before any softening agents in the compartment or pouch.

It may even be possible that part or all of the components are not pre-granulated, such as agglomerated, spray-dried, extruded, prior to incorporation into the compartment, and that the component is a mixture of dry-mixed powder ingredients or even raw materials. Preferred may be that for example less than 60% or even less than 40% or even less than 20% of the component is a free-flowable pre-granulated granules.

Also, it has been found that it is beneficial for the cleaning performance, when the cleaning compositions herein or the material of the compartment or pouch, preferably both the composition and said material, comprise one or more chelating agents, in particular phosphonate- and/or carboxylate-containing chelating agents, in particular EDDS or EDTA or HEDP.

It has also been found that the presence in the wash water of high levels of certain dissolved compartment or pouch material having free hydroxy groups can have a negative effect on the removal of clay stains, under certain wash conditions. Therefore, it is not only beneficial to use as little compartment material as possible and thus to use preferably a pouch with only one compartment, but it has also been found that it is beneficial to incorporate in the composition or the pouch material a polyalkoxylated compound, preferably a polyalkoxylated alcohol, preferably having an average alcohol carbon chain length of 11 to 24, preferably 12 to 20 or even 14 to 18, and an average alkoxylation degree of at least 20 or even at least 40 or even at least 70. Highly preferred are from 0.1% to 8%, or even from 0.5 to 5% or even from 0.8% to 3% by weight of the pouched composition of such a compound; highly preferred is TAE80.

The composition may also comprise liquid compounds or gels or solutions of compounds, for example liquid or gel nonionic surfactants, liquid fabric softeners, preferably then comprised in a separate compartment of the pouch.

Another preferred ingredient is a perhydrate bleach, such as salts of percarbonates, particularly the sodium salts, and/or organic peroxyacid bleach precursor or activator compound. When the pouch or compartment is formed from a material with free hydroxy groups, such as PVA, the preferred bleaching agent comprises a percarbonate salt and is preferably free form any perborate salts or borate salts. It has been found that borates and perborates interact with these hydroxy-containing materials and can reduce the dissolution of the materials and also that this may result in reduced performance.

Preferred activators or precursors are alkyl percarboxylic precursor compounds of the imide type include the N-,N,$N^1N^1$ tetra acetylated alkylene diamines wherein the alkylene group contains from 1 to 6 carbon atoms, particularly those compounds in which the alkylene group contains 1, 2 and 6 carbon atoms such as tetraacetyl ethylene diamine (TAED), sodium 3,5,5-tri-methyl hexanoyloxybenzene sulfonate (iso-NOBS), sodium nonanoyloxybenzene sulfonate (NOBS), sodium acetoxybenzene sulfonate (ABS) and pentaacetyl glucose, but also amide substituted alkyl peroxyacid precursor compounds.

Highly preferred ingredient for use herein are one or more enzymes. Preferred enzymes include the commercially available lipases, cutinases, amylases, neutral and alkaline proteases, cellulases, endolases, esterases, pectinases, lactases and peroxidases conventionally incorporated into detergent compositions. Suitable enzymes are discussed in U.S. Pat. Nos. 3,519,570 and 3,533,139. Preferred commercially available protease enzymes include those sold under the tradenames Alcalase, Savinase, Primase, Durazym, and Esperase by Novo Industries A/S (Denmark), those sold under the tradename Maxatase, Maxacal and Maxapem by Gist-Brocades, those sold by Genencor International, and those sold under the tradename Opticlean and Optimase by Solvay Enzymes. Preferred amylases include, for example, α-amylases obtained from a special strain of B lichenifornis, described in more detail in GB-1,269,839 (Novo). Preferred commercially available amylases include for example, those sold under the tradename Rapidase by Gist-Brocades, and those sold under the tradename Termamyl, Duramyl and BAN by Novo Industries A/S. Highly preferred amylase enzymes maybe those described in PCT/ US 9703635, and in WO95/26397 and WO96/23873. The lipase may be fungal or bacterial in origin being obtained, for example, from a lipase producing strain of *Humicola* sp., *Thermomyces* sp. or *Pseudomonas* sp. including *Pseudomonas pseudoalcaligenes* or *Pseudomas fluorescens*. Lipase from chemically or genetically modified mutants of these strains are also useful herein. A preferred lipase is derived from *Pseudomonas pseudoalcaligenes*, which is described in Granted European Patent, EP-B-0218272.

Another preferred lipase herein is obtained by cloning the gene from *Humicola lanuginosa* and expressing the gene in *Aspergillus oryza*, as host, as described in European Patent Application, EP-A-0258 068, which is commercially available from Novo Industri A/S, Bagsvaerd, Denmark, under the trade name Lipolase. This lipase is also described in U.S. Pat. No. 4,810,414, Huge-Jensen et al, issued Mar. 7, 1989.

Preferred are also anionic surfactants, which include salts (including, for example, sodium, potassium, ammonium, and substituted ammonium salts such as mono-, di- and triethanolamine salts) of the anionic sulfate, sulfonate, carboxylate and sarcosinate surfactant, preferably linear or branched alkyl benzene sulfonate, alkyl sulphates and alkyl ethoxylsulfates, isethionates, N-acyl taurates, fatty acid amides of methyl tauride, alkyl succinates and sulfosuccinates, monoesters of sulfosuccinate (especially saturated and unsaturated $C_{12}$–$C_{18}$ monoesters) diesters of sulfosuccinate (especially saturated and unsaturated $C_6$–$C_{14}$ diesters), N-acyl sarcosinates. Highly preferred is that when anionic surfactants are present, at least one alkyl sulphate surfactant is present, preferably a branched alkyl sulphate surfactant, preferably at a level of 1% to 20% or even to 15% by weight of the composition.

Also preferred are also nonionic surfactants such as nonionic surfactant selected from the classes of the nonionic condensates of alkyl phenols, nonionic ethoxylated alcohols, nonionic ethoxylated/propoxylated fatty alcohols, nonionic ethoxylate/propoxylate condensates with propylene glycol, and the nonionic ethoxylate condensation products with propylene oxide/ethylene diamine adducts.

Cationic surfactants and softening agents may also be present herein, for example quaternary ammonium surfactants and softening agents, and choline ester surfactants.

Colouring agent such as iron oxides and hydroxydes, azo-dyes, natural dyes, may also be present in the composition or preferably in the compartment or pouch material, preferably present at levels of 0.001% and 10% or even 0.01 to 5% or even 0.05 to 1% by weight of the pouched composition In one preferred embodiment of the present invention, the composition in the pouch comprises a first particulate component which forms a first fixed region in the compartment of the pouch and comprises perfume, and a second particulate component which forms a second fixed region in the compartment of the pouch comprises a member selected from the group consisting of bleach, nonionic surfactant, polyethylene glycol having a molecular weight of 4000 or more, enzyme, and combinations thereof. Typically, the second component is free from perfume. In this preferred embodiment of the present invention, the perfume in the composition is more stable since is contained in a separate fixed layer to the above ingredients which cause instability of the perfume. This allows the perfume to remain stable in the composition comprising perfume destabilizing ingredient.

Pouch and Compartment(s) Thereof

The pouch herein has a closed structure, made of materials described herein, enclosing a volume space which comprises the composition. Thus, the pouch can be of any form, shape and material which is suitable to hold the composition prior to use, e.g. without allowing the release of the composition from the pouch prior to contact of the pouched composition to water. The exact execution will depend on for example the type and amount of the composition in the pouch, the number of compartments in the pouch, the characteristics required from the pouch to hold, protect and deliver or release the compositions.

The pouch may be of such a size that it conveniently contains either a unit dose amount of the composition herein, suitable for the required operation, for example when the composition is a detergent composition, this may be a sufficient amount for one wash, or only a partial dose, to allow the consumer greater flexibility to vary the amount used, for example depending on the size and/ or degree of soiling of the wash load.

Preferably, the pouched composition is formed in a mold with a round or flat bottom and round walls. Thus, preferred is also that the pouched composition is a spheroid or more preferably cylinder-shaped.

The pouch has one or more compartments, whereof at least one holds at least two different particulate components. In a preferred execution, all particulate components are present in one and the same compartment of the pouch; it may be preferred that the pouch only has one compartment. This reduces the material needed to form the compartment and pouch. However, it may be preferred that one or more additional compartments for liquid component are present in addition to the compartment comprising the two or more particulate components.

The compartment of the pouch has a closed structure, made of materials described herein, enclosing a volume space which comprises the components. Thus, the compartment is suitable to hold the particulate components prior to use, e.g. without allowing the release of the components from the compartment prior to contact of the pouched composition to water. The compartment can have any form or shape, depending on the nature of the material of the compartment, the nature of the components or composition, the intended use, amount of the components etc. If more than one compartment is present, the compartments are linked or connected to one another by any means, for example sealed by heat sealing or by wetting sealing, glued by any known glue material, examples of which are described hereinafter.

Preferably, the compartment or preferably the pouch as a whole is made of a material which is stretchable, as set out herein. This for example facilitates the closure of the open compartment shape which is filled for more than 95% by volume or even 100% or even over filled as described above. Moreover, the material is preferably elastic, to ensure the tight packing and fixation of the regions remains during handling, e.g. to ensure no (additional) head space can be form after closure of the compartment.

Preferred stretchable materials have a maximum stretching degree of at least 150%, preferably at least 200%, more preferably of at least 400% as determined by comparison of the original length of a piece of material with the length of this piece of material just prior to rupture due to stretching, when a force of at least 1 Newton is applied. Preferably, the material is such that it has a stretching degree as before, when a force of at least 2Newton, or even at least 3 Newton is used. Preferably, it has this stretching degree when a force of the above lower limits is used, but not more than 20 Newton, or even 12 Newton, or even 8 Newton. For example, a piece of film with a length of 10 cm and a width of 1 cm and a thickness of 40 microns is stretched lengthwise with a 2.8 Newton force and thus an increasing stress, up to the point that it ruptures. The extent of elongation just before rupture can be determined by continuously measuring the length and the degree of stretching can be calculated. For example, this piece of film with an original length of 10 cm can be stretched with a force of 2.8 Newton to 52 cm just before breaking, and then is has a maximum stretching degree of 520%.

The force to stretch such a piece of film (10 cm×1 cm×40 microns) to a degree of 200% should preferably be at least I Newton, preferably at least 2 Newton, more preferably at least 2.5 or even 3 Newton, and preferably no more than 20 Newton, preferably less than 12 Newton, most preferably less than 8 Newton. This in particular ensures that the elastic force remaining in the film after forming is high enough to immobilize the powders within the pouch, but not so high that the film cannot be drawn into a vacuum mold of reasonable depth.

As is clear form the definition herein, the stretchable material is defined by a degree of stretching measured when it is not present in the closed compartment. However, as said above, the material is preferably stretched when forming the compartment. This can for example been seen by printing a grid onto the material, e.g. film, prior to stretching, then forming a compartment with the component from this material with grid. It can be seen that squares of the grid are elongated and thus stretched.

The elasticity of the stretchable material of the compartment, and preferably the pouch as a whole can be defined as the 'elasticity recovery'. This can be determined by stretching the material for example to an elongation of 200%, as set out above, and measuring the length of the material after release of the stretching force. For example a piece of film of a length of 10 cm and width 1 cm and thickness of 40 microns is stretched lengthwise to 20 cm (200% elongation) with a force of 2.8 Newtons (as above), and then the force is removed. The film snaps back to a length of 12 cm, which means 80% elastic recovery.

The elasticity of the pouch material referred to herein, is the elasticity at the time of making the pouch. Prolonged stretching, for example that typically occurs during storage of the pouch, will decrease the elasticity of the pouch material due to plastic creeping. It is preferred that at the time of making the pouch or compartment thereof, the compartment material has an elasticity such that the elastic recovery is from 20% to 100%, more preferably from 50% or from 60% or more preferably from 75% or even 80% to 100%.

Thus, the material of the compartment and preferably the pouch as a whole is stretched during formation and/ or closing of the compartment or pouch, such that the resulting pouched composition has a compartment or pouch which is at least partially stretched. Typically and preferably, the degree of stretching in non-uniform over the compartment or pouch, due to the formation and closing process. For example, when a film is positioned in a mold and an open compartment is formed by vacuum forming (and then filled with the components and then closed) the part of the film in the bottom of the mold, furthest removed form the points of closing, will be stretched more than in the top part. Preferably, the elastic material which is furthest away from the opening, e.g. the material in the bottom of the mold, will be stretched more and be thinner than the material closest by the opening, e.g. at the top part of the mold. Therefor, it may be preferred that the component to be delivered first to the water is comprised in a bottom layer of the compartment, and a component which is to be delivered to the water at a later stage is comprised in a subsequent layer, closer to the top of the compartment. Alternatively, or in addition, it may be preferred that the least moisture sensitive component is comprised in the bottom layer of the compartment and a more moisture sensitive component is comprised in a subsequent or top layer.

As said before, another advantage of using stretchable and preferably also elastic material, is that the stretching action, when forming the shape of the compartment and/ or when closing the compartment, stretches the material of the compartment non-uniformly, which results in a compartment and pouch which has a non-uniform thickness. This allows control of the dissolution of water-soluble pouches herein, and for example sequential release of the components of the composition in the pouch to the water.

Preferably, the material is stretched such that the thickness variation in the compartment or pouch formed of the stretched material is from 10 to 1000%, preferably 20% to 600%, or even 40% to 500% or even 60% to 400%. This can be measured by any method, for example by use of an appropriate micrometer.

Material of Pouch and Compartment

Preferably, the composition is a composition to be delivered to water and thus the pouch and the compartment (s) thereof are designed such that at least one or more of the components is released at, or very shortly after, the time of addition to the water. Thus it is preferred that the compartment and preferably the pouch as a whole comprises material which is water-dispersible or more preferably water-soluble.

It is especially preferred that at least one component is delivered to the water within 3 minute, preferably even within 2 minutes or even within I minute after contacting the pouched composition to water.

Preferred water-dispersible material herein has a dispersibility of at least 50%, preferably at least 75% or even at least 95%, as measured by the method set out hereinafter using a glass-filter with a maximum pore size of 50 microns. More preferably the material is water-soluble and has a solubility of at least 50%, preferably at least 75% or even at least 95%, as measured by the method set out hereinafter using a glass-filter with a maximum pore size of 20 microns, namely:

Gravimetric method for determining water-solubility or water-dispensability of the material of the compartment and/or pouch:

10 grams±0.1 gram of material is added in a 400 ml beaker, whereof the weight has been determined, and 245ml±1 ml of distilled water is added. This is stirred vigorously on magnetic stirrer set at 600 rpm, for 30 minutes. Then, the mixture is filtered through a folded qualitative sintered-glass filter with the pore sizes as defined above (max. 20 or 50 micron). The water is dried off from the collected filtrate by any conventional method, and the weight of the remaining polymer is determined (which is the dissolved or dispersed fraction). Then, the % solubility or dispensability can be calculated.

Preferred materials are polymeric materials, preferably polymers which are formed into a film or sheet. The material in the form of a film can for example be obtained by casting, blow-molding, extrusion or blow extrusion of the polymer material, as known in the art.

Preferred polymer copolymers or derivatives thereof are selected from polyvinyl alcohols, polyvinyl pyrrolidone, polyalkylene oxides, (modified) cellulose, (modified) cellulose-ethers or -esters or -amides, polycarboxylic acids and salts including polyacrylates, copolymers of maleic/ acrylic acids, polyaminoacids or peptides, polyamides including polyacrylamide, polysaccharides including starch and gelatine, natural gums such as xanthum and carragum.

Preferably, the polymer is selected from polyacrylates and acrylate copolymers, including polymethacrylates, methylcellulose, sodium carboxymethylcellulose, dextrin, maltodextrin, ethylcellulose, hydroxyethyl cellulose, hydroxypropyl methylcellulose,; most preferably polyvinyl alcohols, polyvinyl alcohol copolymers and/ or hydroxypropyl methyl cellulose(HPMC).

The polymer may have any weight average molecular weight, preferably from about 1000 to 1,000,000, or even form 10,000 to 300,000 or even form 15,000 to 200,000 or even form 20,000 to 150,000.

Mixtures of polymers can also be used. This may in particular be beneficial to control the mechanical and/or dissolution properties of the compartment or pouch, depending on the application thereof and the required needs. For example, it may be preferred that a mixture of polymers is present in the material of the compartment, whereby one polymer material has a higher water-solubility than another polymer material, and/ or one polymer material has a higher mechanical strength than another polymer material. It may be preferred that a mixture of polymers is used, having different weight average molecular weights, for example a mixture of PVA (or a copolymer thereof) and/ or HPMC of a weight average molecular weight of 10,000–40,000, preferably around 20,000, and of PVA (or copolymer thereof) and/ or HPMC with a weight average molecular weight of about 100,000 to 300,000, preferably around 150,000.

Also useful are polymer blend compositions, for example comprising hydrolytically degradable and water-soluble polymer blend such as polylactide and polyvinyl alcohol, achieved by the mixing of polylactide and polyvinyl alcohol, typically comprising 1–35% by weight polylactide and approximately 65–99 by weight polyvinyl alcohol, if the material is to be water-dispersible, or water-soluble.

It may be preferred that the polymer present in the material of the compartment is from 60–98% hydrolyzed, preferably 80% to 90%, to improve the dissolution of the material.

Most preferred are materials which are water-soluble stretchable and elastic material comprising PVA polymer having properties such as the PVA films sold under the trade reference M8630, as sold by Chris-Craft Industrial Products of Gary, Ind. US.

Preferably, the level of a type polymer (e.g. commercial mixture) in the film material, for example PVA polymer, is at least 60% by weight of the material or film, preferably at least 60% or even at least 70% or even at least 80 or 90%. The upper level is up to 100%, but typically 99% or even 98% by weight.

The material herein may comprise other additive ingredients then the polymer or polymer material. For example, it may be beneficial to add plasticisers, for example glycerol, ethylene glycol, diethyleneglycol, propylene glycol, sorbitol and mixtures thereof, additional water, disintegrating aids. It may be useful when the pouched composition is a detergent composition, that the pouch or compartment material itself comprises a detergent additive to be delivered to the wash water, for example organic polymeric soil release agents, dispersants, dye transfer inhibitors.

The material in the form of a film may be coated, preferably only one-sided, with any coating method and with any coating agent, depending on the required properties; for example, it may be beneficial to coat the film such that the compartment or pouch or composition therein, is more storage stable and/or less sensitive to moisture and/ or acts as a improved moisture barrier.

A very useful form is to coat the material or film on one side with a coating that slows the dissolution of the film, prior to forming of the compartment and thus prior to stretching the material or film. Then, by stretching the material or film, the coating is stretched as well, resulting in cracks in the coating and/ or uneven distribution of the coating over the material and thus over the compartment. This then ensures still stability against moisture during storage, whilst the presence of cracks or the uneven distribution still ensures the required dissolution in use. Hence it is possible to make a pouched composition that is resistant to being handled with wet fingers when it is picked up at the sides but will still release product rapidly when it is immersed in water due to film rupture at the thinnest points.

Any coating material can be used, particular useful are hydrophobic coatings, or polymers with a low water-solubility, lower then defined herein before.

The compartment material may be shrinkable material, so that the surface area can be reduced during or subsequent to closing the open compartment by shrinking the material.

Preferably, the open compartment is closed with a piece of the same material as the material of the open compartment. The closing material, and thus preferably also the open compartment material or shape material, is preferably thermoplastic so that it can be closed by heat-sealing. Alternatively, a thermoplastic coating may be provided, either over the whole material or just in the areas where seals are to be formed. The sealing can also be made by solvent welding or wetting sealing. Suitable heat-sealable materials include polyvinyl alcohol, polyvinyl acetate, polyvinyl pyrrolidone, polyethylene oxide, acrylic resins and mixtures thereof, in particular polyvinyl alcohols.

EXAMPLES

Example 1

A piece of Chris-Craft M-8630 film, 38 microns thick, is placed on top of a mold and fixed in place. The mold consists of a cylindrical shape with a diameter of 45 mm and a depth of 25 mm. A 1 mm thick layer of film remains present around the edges of the mold. The mold has some holes in the mold material to allow a vacuum to be applied.

A vacuum is applied to stretch the film into the mold and pull the film flush with the inner surface of the mold. 20 g of a detergent powder mix comprising percarbonate salt and water-soluble salts and organic acids, typically carbonate salts, citric acid and/ or citrate is poured into the mold. This powder mix has a bulk density of 860 g/l prior to being poured into the mold. Then, 20 g of a detergent powder mix comprising enzymes, bleach activator and surfactants is poured into the mold. This powder mix has a bulk density of 900 g/l prior to being poured into the mold.

The mold is filled between 95% to 105%.

Next, a sheet of the same M-8630 film is placed over the top of the mold with the powder and sealed to the first layer of film by applying an annular piece of flat metal of an inner diameter of 46 mm and heating that metal under moderate pressure onto the ring of rubber at the edge of the mold, to heat-seal the two pieces of film together. The metal ring is typically heated to a temperature of 140–146° C. and applied for up to 5 seconds. The film is stretched during this process.

The bulk density of the pouched composition was then tested by the method described above and found to be 1020 g/l.

Pouches made by the above method released product on immersion in 5 liters of 10° C. water in less than 10 seconds.

Example 2

A two layer pouched composition containing a detergent composition is prepared as follows.

A piece of 38 micron film is placed over a mold of the following dimensions and fixed in place such that the film is level with the top of the mold.

Circular diameter of bottom of mold: 28 mm; circular diameter of top of mold: 37 mm; depth of mold 18 mm A vacuum is applies to the film such that it is drawn into the mold and becomes flush with the sides of the mold. 11.75 grams of the following component (A) was poured into the film in the mold.

| Component A | |
|---|---|
| Enzymes | 2.5% |
| Surfactant Agglomerates | 41.6% |
| Effervescent Particle | 6.9% |
| Anti-foam particle | 7.2% |
| Sodium Carbonate | 28.8% |
| Bleach activators | 13.0% |

This component has a bulk density of 725 g/l.

Then, 2.5 grams of sodium percarbonate is added on top of component A. The sodium percarbonate has a bulk density of 1005 g/l. A second layer of 38 micron M-8630 film is then placed over the powder and mold and sealed to the first layer of film using a similar heat sealing procedure as described in Example 1.

The average bulk density of the pouched composition prior to incorporation in the pouch is therefore 774 g/l. After incorporation in the pouch, the bulk density of the composition was measured as being 951 g/l—an increase of 23%.

Example 3

A two layer pouched composition is made containing enzymes and sodium percarbonate.

The procedure as described in Example 1 is used to make two layer pouched composition consisting of 36 grams of sodium percarbonate and 4 grams of Termamyl 120 (as supplied by Novo Industries). The sodium percarbonate forms the lower layer and the enzyme the top layer.

Single-layer pouched composition is then made as per the procedure described in Example 1 but with the enzymes and percarbonate mixed homogeneously together.

Both pouched compositions have a density increase of 18%. In both situations the film of the pouch is stretched.

Both types of pouched compositions are then stored in conditions of high temperature and humidity (90° F., 80% Relative Humidity) without any kind of outer-wrap or packaging protection. Samples were taken after 48 hours storage and 96 hours and the activity of the enzymes in the two product are compared with one another. The activity of the enzyme in the single layer pouch after 48 hours is only about 30% of the activity of the enzyme in the dual layer pouched composition; the activity of the enzyme in the single layer pouch after 96 hours is only about 20% of the activity of the enzyme in the dual layer pouched composition.

This shows the increased storage stability by using fixed regions or layers to separate incompatible materials.

The following are detergent compositions which may also be suitable incorporated in a pouch of the invention:

| | A | B | C | D | E | F | G | H | I |
|---|---|---|---|---|---|---|---|---|---|
| First top layer: Spray-dried Granules | | | | | | | | | |
| LAS | 10.0 | 10.0 | 15.0 | 5.0 | 5.0 | 10.0 | — | — | — |
| TAS | — | 1.0 | — | | | | — | — | — |
| branched or linear synthetic alkyl sulphate surfactant | — | — | 2.0 | 5.0 | 5.0 | | — | — | — |
| cationic surfactant | | | 1.0 | 1.0 | | | — | — | — |
| DTPA, HEDP and/or EDDS | 0.3 | 0.3 | 0.5 | 0.3 | | | — | — | — |
| MgSO4 | 0.5 | 0.5 | 0.1 | — | | | — | — | — |
| Sodium citrate | — | — | — | 3.0 | 5.0 | | — | — | — |
| Sodium carbonate | 10.0 | 7.0 | 15.0 | | | 10.0 | — | — | — |
| Sodium sulphate | 5.0 | 5.0 | — | — | 5.0 | 3.0 | — | — | — |
| Sodium silicate 1.6R | — | — | — | — | 2.0 | | — | — | — |
| Zeolite A | 16.0 | 18.0 | 20.0 | 20.0 | — | — | — | — | — |
| SKS-6 | — | — | — | 3.0 | 5.0 | — | — | — | — |
| polyacrylic and/or polymaleic acid polymer, or salt | 1.0 | 2.0 | 11.0 | — | — | 2.0 | — | — | — |
| PEG 4000 | — | 2.0 | — | 1.0 | — | 1.0 | — | — | — |
| Brightener | 0.05 | 0.05 | 0.05 | — | 0.05 | — | — | — | — |
| Silicone oil | 0.01 | 0.01 | 0.01 | — | — | 0.01 | — | — | — |
| effervescence granule of 50% citric acid and 50% | 10 | 7.0 | — | — | — | — | — | — | — |

-continued

| | A | B | C | D | E | F | G | H | I |
|---|---|---|---|---|---|---|---|---|---|
| sodium carbonate | | | | | | | | | |
| middle layer: Agglomerate | | | | | | | | | |
| LAS | | | — | — | — | — | 2.0 | 2.0 | — |
| branched or linear synthetic alkyl sulphate surfactant | | | — | — | — | — | — | 4.0 | 4.0 |
| ethoxylated alkyl sulphate surfactant | | | — | — | — | — | — | 1.0 | 0.5 |
| Carbonate | | | — | — | 4.0 | 1.0 | 1.0 | 1.0 | — |
| Sodium citrate | | | — | — | — | — | — | — | 5.0 |
| Citric acid | | | — | — | — | 4.0 | — | 1.0 | 1.0 |
| SRP | | | — | — | — | 1.0 | 1.0 | 0.2 | — |
| Zeolite A | | | — | — | — | 15.0 | 26.0 | 15.0 | 16.0 |
| PEG | — | — | — | — | — | — | 4.0 | — | — |
| SKS-6/LAS agglomerate | 6.0 | 10.0 | — | — | 9.0 | 6.0 | — | 7.0 | 10.0 |
| nonionic surfactant | — | 2.0 | 1.0 | — | 5.0 | 0.5 | — | 0.7 | — |
| Enzymes (cellulase, amylase, protease, lipase) | 1.3 | 0.3 | 0.5 | 0.5 | 0.8 | 2.0 | 0.5 | 0.16 | 0.2 |
| Perfume | 1.0 | 0.5 | 1.1 | 0.8 | 0.3 | 0.5 | 0.3 | 0.5 | — |
| Citrate/citric acid | — | — | 20.0 | 4.0 | — | 5.0 | 15.0 | — | 5.0 |
| Photobleach | 0.02 | 0.02 | 0.02 | 0.1 | 0.05 | — | 0.3 | — | 0.03 |
| Bottom layer: Dry-add particulate components | | | | | | | | | |
| effervescence granule (as above) | — | 4.0 | 10.0 | 4.0 | 25 | 8.0 | 12.0 | 2.0 | 4.0 |
| TAED | 2.5 | — | — | 1.5 | 2.5 | 6.5 | — | 1.5 | — |
| MBAS | — | — | — | 8.0 | — | — | 8.0 | — | 4.0 |
| LAS (flake) | 10.0 | 10.0 | — | — | — | — | — | 8.0 | — |
| sodium percarbonate | 15.0 | — | — | 10.0 | 15.0 | 5.0 | — | 11.0 | — |
| speckle | — | — | — | 0.3 | 0.05 | 0.1 | — | — | — |
| Suds suppressor | 1.0 | 0.6 | 0.3 | — | 0.10 | 0.5 | 1.0 | 0.3 | 1.2 |
| Soap | 0.5 | 0.2 | 0.3 | 3.0 | 0.5 | — | — | 0.3 | — |
| Fillers up to 100% | | | | | | | | | |

What is claimed is:

1. A cleaning composition releasably contained within a water-soluble or water-dispersible pouch comprising a compartment, the composition comprising two or more incompatible particulate components, said components being present in one and the same compartment and each particulate component forming respectively, a fixed region in said compartment, wherein said compartment has essentially no free head-space which would allow the components to move from their respective fixed regions.

2. A composition contained within a pouch according claim 1 obtainable by a process comprising the steps of:

a) obtaining an open pouch comprising an open compartment;

b) introducing one particulate component prior to at least one other particulate component in the open compartment and/or introducing one particulate component in a different part of the open compartment than at least one other particulate component; and c) subsequently closing the open compartment such that a pouch with a compartment comprising fixed regions of said particulate components is obtained.

3. A composition contained within a pouch according o claim 2 whereby the process comprises the step of increasing the bulk density of the components such that the bulk density of the composition after closing the compartment is from 5% to 35% higher than the average of the bulk density of the components prior to introduction into the compartment.

4. A composition contained within a pouch according to claim 3 whereby the process comprises the step of increasing the bulk density of the components such that the bulk density of the composition after closing the compartment from 10% to 25% higher than the average of the bulk density of the components prior to introduction into the compartment.

5. A composition contained within a pouch according claim 1, whereby the compartment is formed from a stretchable material.

6. A composition according to claim 2 whereby the compartment is formed from flexible material and step c) is performed under pressure lower than atmospheric pressure.

7. A composition contained within a pouch according to claim 2 wherein the compartment is formed by applying a vacuum.

8. A composition contained within a pouch according a claim 2 whereby the open compartment is rigid and in step b) the components are introduced in the open compartment such at least 100% of the open compartment is occupied by the components.

9. A composition contained within a pouch according to claim 2, whereby the open compartment is rigid and in step b) the components are introduced in the open compartment such that at least 95% of the volume of the open compartment is occupied by the components.

10. A composition contained within a pouch according to claim 2, whereby the compartment is formed from a shrinkable material and in step c) the surface area of the compartment is reduced during or subsequent to closing the open compartment by shrinking the compartment and/or open compartment by heat-shrinking.

11. A composition contained within a pouch according to claim 2, whereby the open compartment is obtainable by introducing a stretchable film into a mould and stretching the film so that the film adopts the form of the mould to form an open compartment wherein said stretching is performed by a process selected from the group consisting of thermoforming, vacuum forming, or combinations thereof.

12. A composition contained within a pouch according to claim 1, whereby the compartment is formed from a material of non-uniform thickness, having a variation in thickness of at least 10%.

13. A composition contained within a pouch according to claim 1, whereby the compartment is formed from a stretchable film having a maximum stretching degree of at least 200%, and an elastic recovery of from 20% to 100%.

14. A composition contained within a pouch according to claim 1, whereby the compartment and the pouch are water-soluble.

15. A composition contained within a pouch according to claim 1, whereby the regions are in the form of layers.

16. A composition in a pouch according to claim 1, whereby the compartment is formed from a film comprising polyvinyl alcohol polymer.

17. A composition in a pouch according to claim 1, whereby one component comprises a hygroscopic compound and another component comprises a moisture-sensitive compound.

18. A composition in a pouch according to claim 1, whereby one component comprises an enzyme compound and another component comprises a peroxygen bleach.

* * * * *